US007336246B2

(12) United States Patent
Miura

(10) Patent No.: US 7,336,246 B2
(45) Date of Patent: Feb. 26, 2008

(54) DISPLAY APPARATUS, DISPLAY METHOD AND METHOD OF MANUFACTURING A DISPLAY APPARATUS

(75) Inventor: Hirotsuna Miura, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 605 days.

(21) Appl. No.: 10/843,425

(22) Filed: May 12, 2004

(65) Prior Publication Data

US 2005/0007355 A1 Jan. 13, 2005

(30) Foreign Application Priority Data

May 26, 2003 (JP) ..... 2003-147620

(51) Int. Cl.
*G09G 3/30* (2006.01)

(52) U.S. Cl. ..... 345/76; 345/207

(58) Field of Classification Search ..... 345/36, 345/45, 46, 48, 76, 80, 81, 83, 84, 207, 204
See application file for complete search history.

(56) References Cited

U.S. PATENT DOCUMENTS 6,424,326 B2 * 7/2002 Yamazaki et al. ..... 345/77
6,430,325 B1 8/2002 Shimoda
7,061,452 B2 * 6/2006 Inoue et al. ..... 345/76

FOREIGN PATENT DOCUMENTS

| | | |
|---|---|---|
| CN | 1142738 A | 2/1997 |
| CN | 1287691 A | 3/2001 |
| CN | 091124230 | 10/2003 |
| JP | A 05-094150 | 4/1993 |

* cited by examiner

*Primary Examiner*—Richard Hjerpe
*Assistant Examiner*—Jean Lesperance
(74) *Attorney, Agent, or Firm*—Oliff & Berridge, PLC

(57) ABSTRACT

To precisely reduce fluctuations in brightness of respective light emitters when displaying an image by having a plurality of light emitters emit light, and thereby improve image quality. A display apparatus can be made of an arrangement of a plurality of pixels respectively composed of a predetermined driving circuit and a light emitter that emits light when driven by the driving circuit. Each pixel can include a correction circuit that detects an amount of light for the light emitter using a light receiver made of the same type of material as the light emitter and implements feedback control over the driving circuit based on a detection result.

6 Claims, 2 Drawing Sheets

DISPLAY APPARATUS, DISPLAY METHOD AND METHOD OF MANUFACTURING A DISPLAY APPARATUS

BACKGROUND OF THE INVENTION

1. Field of Invention

The present invention relates to a display apparatus and a display method.

2. Description of Related Art

As is well known, much research and development has been conducted into organic electroluminescent (EL) display apparatuses due to their promise as next generation display apparatuses. Such organic EL display apparatuses use organic EL materials as the light emitter composing each pixel, and an active matrix method is normally used as the driving method for such organic EL materials.

However, when such organic EL display apparatuses are constructed with a large screen, there is an inevitable lowering in image quality due to fluctuations in brightness between the light emitters of the respective pixels. For example, in the case of a large color organic EL display apparatus, not only bright spots but color spots appear in the entire display, so that in order to construct organic EL display apparatuses with large screens, a reduction in the amount of fluctuation between the light emitters is essential.

In the field of display apparatuses, a technique for reducing fluctuations in the brightness of respective light emitters is disclosed by Japanese Laid-Open Patent Publication No. H05-94150, for example. According to this technique, as shown in FIG. 1 of the publication, a photodiode 26 (Schottky diode) is additionally provided, and by additionally charging a signal holding capacitor 23 using this photodiode 26, corrective control is carried out for an EL light emission controlling TFT 22, that is, light emission by an EL element 24 is corrected, thereby suppressing fluctuations in brightness within the panel screen.

However, with this technique, the photodiode 26 is a Schottky diode made of a semiconductor material, so that the light receiving characteristics are naturally different to the light emitting characteristics of the EL element 24. Accordingly, the differences between such light receiving characteristics and light emitting characteristics cause a problem in that it is not possible to properly correct the light emission of the EL element 24.

SUMMARY OF THE INVENTION

It is an object of the invention to precisely reduce fluctuations in brightness for light emitters when displaying images through light emission by a plurality of light emitters, thereby improving image quality.

In order to achieve the above object, as means relating to a display apparatus, the invention is a display apparatus that can include an arrangement of a plurality of pixels respectively composed of a predetermined driving circuit and a light emitter that emits light when driven by the driving circuit, and uses a construction in which each pixel includes a correction circuit that detects an amount of light for the light emitter using a light receiver made of the same type of material as the light emitter and implements feedback control over the driving circuit based on a detection result.

Also, the invention can be a display method that displays an image by individually driving light emitters provided corresponding to a plurality of arranged pixels. An amount of light is detected individually for the respective light emitters using light receivers composed of the same type of material as the light emitters and feedback control is implemented for driving the light emitters based on detection results. According to the above, an amount of light emitted by the light emitter is detected by a light receiver composed of the same material as the light emitter, and feedback control is carried out over the driving of the light emitter based on this detection result. In other words, feedback control can be carried out over the driving of the light emitter based on a light receiving result of a light receiver with light receiving characteristics that resemble the light emitting characteristics of the light emitter, so that it is possible to make the brightness of the light emitted by individual pixels in an arrangement of a plurality of pixels uniform with greater precision than in the conventional art.

In addition, by using an additional device that also detects external light and carries out feedback control over a driving circuit based on this detection result, it is possible to control the brightness of every pixel in accordance with the external light.

In addition, in the case where the light emitters are formed of an organic EL material, that is, when using an additional construction suited to displaying images with an organic EL material as the light emitters, it is still possible to make the emitted brightness of the respective light emitters uniform, even when displaying images using such organic EL material.

In the case where an image is displayed by a plurality of pixels arranged in two dimensions, it is possible to make the brightness of the emitted light uniform for each light emitter in the two dimensions.

When images are displayed in color, it can be possible to make the brightness of the emitted light uniform and to also suppress the occurrence of color spots.

In addition, it is possible to form the light emitters and the light receivers by discharge onto the substrate using an ink jet-type droplet discharging apparatus. By doing so, it is possible to form feedback circuits relatively easily without additionally requiring any complex processes, and fluctuations in the discharge amount of the ink jet, which cause unevenness in light emission, are cancelled out, thereby stabilizing the amount of light.

BRIEF DESCRIPTION OF THE DRAWINGS

The invention will be described with reference to the accompanying drawings, wherein like numerals reference like elements, and wherein.

DETAILED DESCRIPTION OF PREFERRED EMBODIMENTS

An embodiment of the invention will now be described with reference to the attached drawings. It should be noted that the present embodiment relates to a case where the invention has been applied to an organic EL display apparatus.

Figure 1:
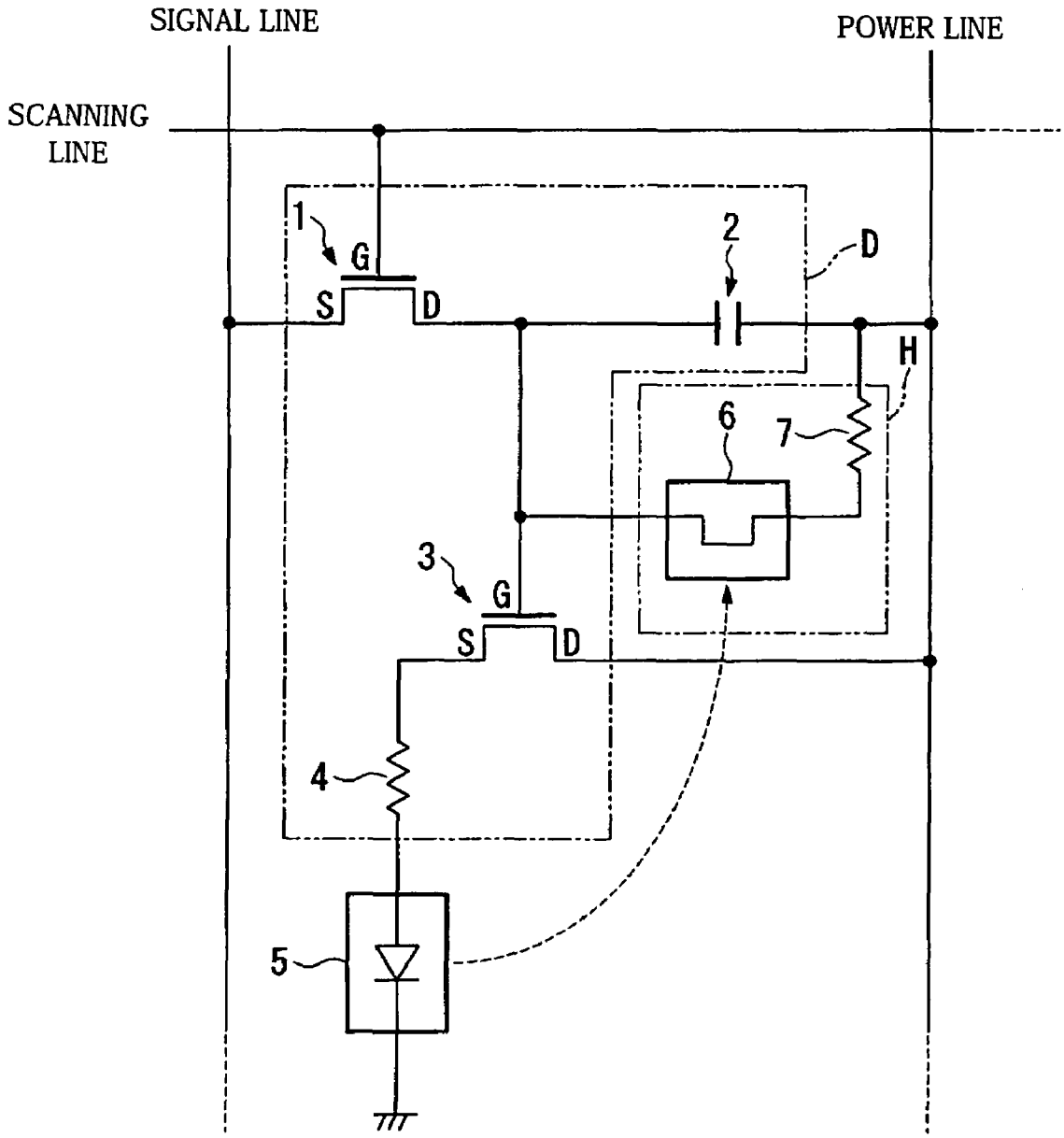
FIG. 1 is an exemplary circuit diagram that electrically constructs a main part (each pixel) of an organic EL display apparatus according to an embodiment of the present invention.

FIG. 1 is an exemplary circuit diagram showing the electrical configuration of a main part (pixels) of this organic EL display apparatus. In FIG. 1, reference numeral 1 designates a first transistor, 2 a capacitor (data voltage holding capacitor), 3 a second transistor, 4 a first resistor, 5 a light emitting organic EL element (light emitter), 6 a light receiving organic EL element (light receiver), and 7 a second resistor. Out of these components, the light receiving organic EL element 6 and the second resistor 7 compose a correction circuit H, while the first transistor 1, the capacitor 2, the second transistor 3, and the first resistor 4 compose a driving circuit D.

These components construct one pixel in the present organic EL display apparatus. In the present organic EL display apparatus, a plurality of such pixels are provided in a regular two-dimensional arrangement in a width direction (horizontal operating direction) and a height direction (vertical scanning direction). Also, in order to display color images, the present organic EL display apparatus is constructed of color pixels that are each composed of three adjacent pixels. That is, three light emitting organic EL elements 5 of respectively different types are selected as the three pixels so that light of each of the three primary colors can be emitted.

The gate terminal of the first transistor 1 is connected to a scanning line, the source terminal is connected to a signal line, and the drain terminal is connected to one end of the capacitor 2, the gate terminal of the second transistor 3, and one end of the light receiving organic EL element 6, respectively. One end of the capacitor 2 is commonly connected to the drain terminal of the first transistor 1, the gate terminal of the second transistor 3, and one end of the light receiving organic EL element 6, while the other end of the capacitor 2 is connected to a power line. The gate terminal of the second transistor 3 is commonly connected to the drain terminal of the first transistor 1, one end of the capacitor 2, and one end of the light receiving organic EL element 6, the source terminal is connected to one end of the first resistor 4, and the drain terminal is connected to the power line.

One end of the first resistor 4 is connected to the source terminal of the second transistor 3, while the other end is connected to one end of the light emitting organic EL element 5. The light emitting organic EL element 5 can function as a photodiode, with one end of the light emitting organic EL element 5 being connected to the other end of the first resistor 4, and the other end being connected to ground. The light receiving organic EL element 6 functions as a phototransistor, with one end of the light receiving organic EL element 6 being commonly connected to the drain terminal of the first transistor 1, the gate terminal of the second transistor 3, and one end of the capacitor 2 and the other end being connected to one end of the second resistor 7. One end of the second resistor 7 is connected to the other end of the light receiving organic EL element 6 described above, while the other end is connected to the power line. The series circuit composed of the light receiving organic EL element 6 and the second resistor 7 constructs the correction circuit H.

The scanning line and the signal line are connected to output terminals of a driving integrated circuit, not shown, with the driving integrated circuit applying predetermined voltages to these lines in accordance with the image to be displayed. The driving integrated circuit, scanning lines, signal lines, power lines, and components described above are formed on a glass substrate by photolithography or an ink jet method.

For example, in one construction, the first transistor 1, the capacitor 2, the second transistor 3, the first resistor 4, the second resistor 7, and the driving integrated circuit are formed on a glass substrate by photolithography, while the scanning lines, signal lines, and power lines are formed by emitting a conductive material and an organic EL material in liquid form onto the glass substrate according to an ink jet method.

The light emitting organic EL element 5 and the light receiving organic EL element 6 are formed on the glass substrate using both photolithography and an ink jet method. In more detail, the light emitting organic EL element 5 and the light receiving organic EL element 6 are formed using an ink jet method that discharges an organic EL material in liquid form onto transparent electrodes (anodes) that have been formed by photolithography or an ink jet method, with cathodes and the like made of metal then being formed on the hardened organic EL material.

When forming the light emitting organic EL element 5 and the light receiving organic EL element 6, two banks that surround predetermined regions on the glass substrate are adjacently formed. Of these two banks, one can be for the light emitting organic EL element, while the other can be for the light receiving organic EL element, with the bank for the light emitting organic EL element being a considerably large region compared to the bank for the light receiving organic EL element and so occupying most of the pixel region. Accordingly, the bank for the light receiving organic EL element is formed in a relatively small region in the pixel region.

A transparent electrode material is also applied inside these two banks by photolithography or an ink jet method so that thin-film transparent electrodes are formed.

After this, an ink jet method can be used to emit an organic EL material onto the transparent electrodes in the respective banks in the same discharge process. In other words, an organic EL material with exactly the same composition is attached inside the two banks to form layers. After this, a cathode material made up of fine particles of metal is discharged onto the hardened organic EL material inside the respective banks to form the cathodes.

It should be noted that the light emitting organic EL element 5 described above can be formed on a glass substrate so that the light emitted by the element 5 is irradiated to the outside via the glass substrate, but the light receiving organic EL element 6 is formed on the glass substrate in a state where external light is blocked so that only the light that has been emitted by the light emitting organic EL element 5 is received. In other words, the light receiving organic EL element 6 in each pixel can be constructed so as to only receive light from the light emitting organic EL element 5 in the same pixel.

Next, the operation of the organic EL display apparatus with the above construction will be described in detail with reference to FIG. 2.

When a selection voltage is temporarily applied to a scan line from the driving integrated circuit, the first transistor 1 is placed in an ON state for only a predetermined period, and the source terminal and drain terminal are shorted. As a result, the data voltage that was applied to the signal line from the driving integrated circuit is applied to one end of the capacitor 2 which is charged by the data voltage, the first transistor 1 is returned to the OFF state, and the data voltage is held. In other words, the voltage at the drain terminal of the first transistor 1 (that is, the voltage of the gate terminal of the second transistor 3) becomes the data voltage due to the capacitor 2 holding the data voltage.

In this way, when a voltage that corresponds to the data voltage is applied to the gate terminal of the second transistor 3, the second transistor 3 is activated and operates as a low-current power source that is controlled by the gate terminal voltage. That is, the current that flows from the drain terminal of the second transistor 3 to the source terminal is a value (light emission driving current) corresponding to the voltage of the gate terminal. As a result, the light emission driving current flows via the first resistor 4 to the light emitting organic EL element 5, so that the light emitting organic EL element 5 emits an amount of light corresponding to this light emission driving current.

The light emitting operation by the organic EL display apparatus is described in detail above, and at the same time, the light receiving organic EL element 6 formed in the same pixel as the light emitting organic EL element 5 described above receives the light emitted by the light emitting organic EL element 5. The magnitude of the current flowing between the terminals of the light receiving organic EL element 6 is a value that depends on the amount of received light, that is, the amount of light emitted by the light emitting organic EL element 5.

Figure 2:
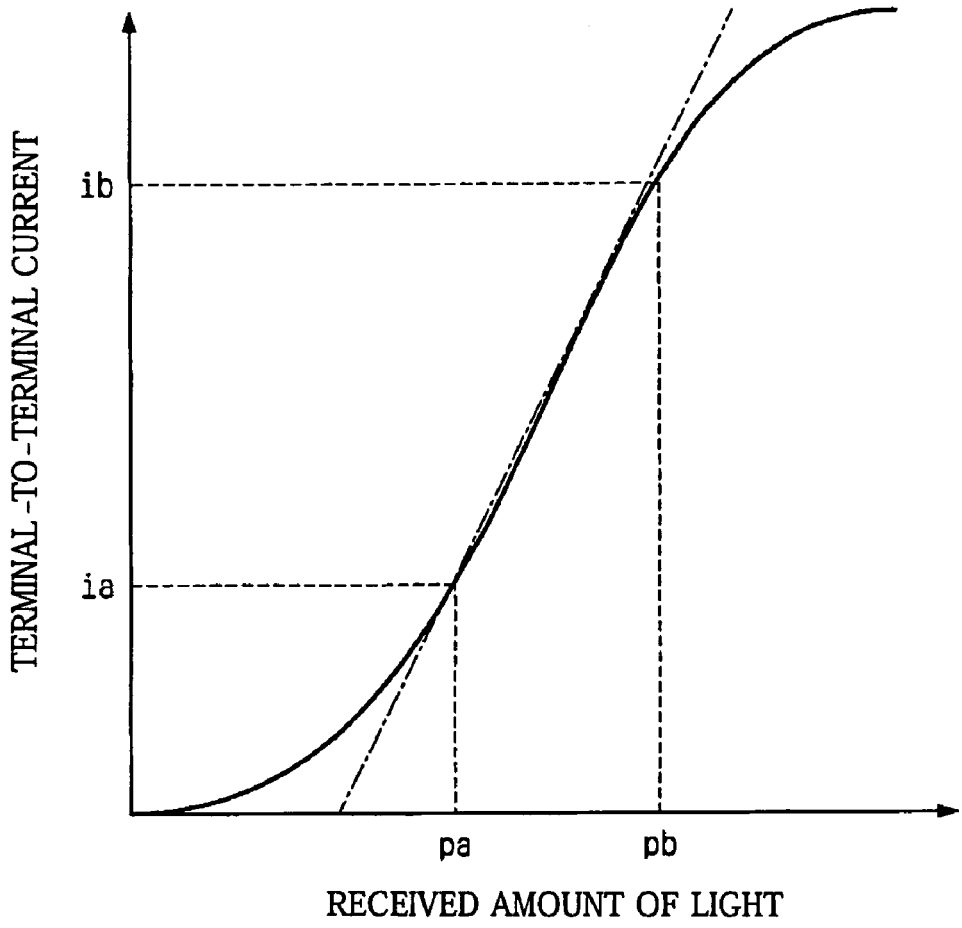
FIG. 2 is a characteristics graph showing the light receiving characteristics of the light receiving organic EL element 6 for the embodiment of the present invention.

FIG. 2 is a characteristics graph showing the light receiving characteristics of the light receiving organic EL element 6. As shown in FIG. 2, the light receiving characteristics are S-shaped characteristics, and have a region (linear region) where the terminal-to-terminal current changes approximately linearly with respect to the received amount of light. In other words, within a range ia to ib, the terminal-to-terminal current is approximately proportionate to the received light amount in a range pa to pb. Accordingly, in this linear region, the terminal-to-terminal current of the light receiving organic EL element 6 linearly changes according to the received amount of light.

Also, the organic EL material making up the light receiving organic EL element 6 can be the same material as the organic EL material making up the light emitting organic EL element 5 described above. Accordingly, the light receiving characteristics of the light receiving organic EL element 6 described above exhibit a high degree of similarity to the light emission characteristics of the light emitting organic EL element 5.

The light receiving organic EL element 6 that has these light receiving characteristics is connected in series to the second resistor 7 and these are connected in parallel to the capacitor 2. In other words, the load of the capacitor 2 can leak via a series circuit composed of the light receiving organic EL element 6 and the second resistor 7. The leak current is determined as the terminal-to-terminal current of the light receiving organic EL element 6 described above.

As can be easily understood from the light receiving characteristics described above, when the amount of received light is large, that is, when the amount of light emitted by the light emitting organic EL element 5 is large, the terminal-to-terminal current of the light receiving organic EL element 6, that is, the leak current, is also large, so that the voltage across the terminals of the capacitor 2 is reduced. As a result, the gate terminal voltage of the second transistor 3 rises to a value closer to the voltage of the power line (power line voltage), resulting in feedback control that reduces the light emission driving current of the light emitting organic EL element 5.

In other words, based on the amount of received light for the light receiving organic EL element 6 whose light receiving characteristics exhibit a high degree of similarity with the light emitting characteristics of the light emitting organic EL element 5, the second transistor 3 is subjected to feedback so that the amount of light emitted by the light emitting organic EL element 5 can be corrected extremely precisely so as to become a predetermined set value. In this organic EL display apparatus, a correction circuit H is provided for every pixel, so that fluctuation in the brightness of emitted light between pixels is suppressed, making it possible to precisely reduce the number of bright spots and color spots compared to the conventional art.

It should be noted that the invention is not limited to the above embodiment, and as examples the following modifications are conceivable.

In this organic EL display apparatus, the light receiving organic EL element 6 is constructed so as to receive only light that has been emitted by the light emitting organic EL element 5, but it is possible to construct the light receiving organic EL element 6 so as to additionally or alternatively received external light.

For example, when the light receiving organic EL element 6 is constructed so as to receive only external light, it is possible to control the brightness of the entire screen based on the intensity of the external light, that is, the peripheral brightness of the organic EL display apparatus. On the other hand, when the light receiving organic EL element 6 is constructed so as to receive both external light and light from the light emitting organic EL element 5, it is possible to reduce fluctuations in the amount of light emitted by the light emitting organic EL element 5 and to control the brightness of the entire screen based on the peripheral brightness.

The above embodiment relates to an organic EL display apparatus, but it should be understood that the invention is not limited to this and can be applied to a display apparatus that uses light emitting materials aside from organic EL materials.

The above embodiment relates to an organic EL display apparatus in which pixels are arranged in two dimensions, but the invention is not limited to this. The invention can be applied to a display apparatus in which pixels are arranged in one dimension, and the arrangement of pixels is not limited to a two-dimensional arrangement.

In addition, although the above embodiment relates to an organic EL display apparatus for displaying color images, the invention is not limited to this and can be applied to a display apparatus that displays black and white images.

As described above, according to the invention the amount of light of a light emitter is detected in each pixel and feedback control is implemented for the driving of the light emitter based on the detection result, so that when an image is displayed by having a plurality of light emitters emit light, it is possible to reduce fluctuation in the brightness of the respective pixels, and therefore improve image quality.

What is claimed is:

1. A display apparatus composed of an arrangement of a plurality of pixels respectively composed of a predetermined driving circuit and a light emitter that emits light when driven by the driving circuit, each pixel including a correction circuit that detects an amount of light for the light emitter using a light receiver made of a same type of material as the light emitter and that implements feedback control over the driving circuit based on a detection result, the correction circuit being composed of a resistor and a phototransistor whose resistance changes in accordance with an amount of received light, and being a series circuit that is coupled in parallel to a data voltage holding capacitor that is a component in the driving circuit.

2. A display apparatus according to claim 1, the correction circuit detecting an amount of external light and implementing feedback control of the driving circuit based on a detection result.

3. A display apparatus according to claim 1, the light receiver being formed of an organic EL display material.

4. A display apparatus according to claim 1, the light emitter being formed of an organic EL display material.

5. A display apparatus according to claim 1, the organic EL display apparatus being composed of a plurality of the pixels arranged in two dimensions.

6. A display apparatus according to claim 1 that displays in color.

* * * * *